US005211743A

United States Patent [19]

Brunner

[11] Patent Number: 5,211,743

[45] Date of Patent: May 18, 1993

[54] TREATMENT OF A MELT WITH A GAS AND MEANS THEREFOR

[75] Inventor: Mikael Brunner, Täby, Sweden

[73] Assignee: AGA Aktiebolag, Lidingo, Sweden

[21] Appl. No.: 776,351

[22] PCT Filed: May 22, 1990

[86] PCT No.: PCT/SE90/00339

§ 371 Date: Nov. 19, 1991

§ 102(e) Date: Nov. 19, 1991

[87] PCT Pub. No.: WO90/15160

PCT Pub. Date: Dec. 13, 1990

[30] Foreign Application Priority Data

May 29, 1989 [SE] Sweden ..... 8901915

[51] Int. Cl.[5] ..... C21C 5/34; C21C 5/48

[52] U.S. Cl. ..... 75/557; 266/218

[58] Field of Search ..... 75/548, 551, 552, 553, 75/554, 556, 557; 417/901; 62/50.2; 266/218

[56] References Cited

U.S. PATENT DOCUMENTS 2,467,413 4/1949 Wildhack ..... 62/50.3
4,321,088 3/1982 Boehm ..... 75/559
4,382,817 5/1983 Vayssiere et al. ..... 75/555
4,627,243 12/1986 Schaub ..... 62/50.2
5,076,837 12/1991 Rathbone et al. ..... 75/958

FOREIGN PATENT DOCUMENTS 99037 1/1984 European Pat. Off. .
8702338 12/1988 Sweden .

*Primary Examiner*—Melvyn J. Andrews
*Attorney, Agent, or Firm*—Pollock Vande Sande & Priddy

[57] ABSTRACT

An arrangement for use when treating a melt, particularly a metal melt (2) in a converter (1) with gas, for the purpose of intensifying and rendering effective the contact between gas and melt and to produce effective admixture of the gas with the melt. The arrangement includes at least one nozzle (5) which discharges into the melt (2) and which is operative to deliver the gas in the form of at least one high pressure jet. For the purpose of producing a high gas pressure of such value as to produce a finely-divided mixture of gas and melt in a jet zone (10) in the melt (2), a pressure-elevating device (9) is incorporated in the fluid line connected to the nozzle (5). The invention also relates to a method of treating a metal melt in a converter.

4 Claims, 1 Drawing Sheet

TREATMENT OF A MELT WITH A GAS AND MEANS THEREFOR

The present invention relates to the gas treatment of a melt, particularly a metal melt, in a converter, and particularly pertains to a method of intensifying and making more effective the contact between gas and melt, and of achieving effective admixture of the gas with the melt. The invention also relates to an arrangement for carrying out such treatment.

In the manufacture of steel, for instance pig iron, scrap or sponge iron is melted down in different furnaces, converters or like apparatus. The carbon content of the melt is reduced by refinement or decarburization of the melt, wherein oxygen gas is introduced into the melt in the case of certain processes. Gas or gas/powder mixtures can also be introduced into the melts for other reasons. In the majority of processes in which melts are treated with gas, a common desideratum is to achieve effective admixture of the gas with the melt, so that the greatest possible part of the melt comes into contact with the gas. The gas itself shall also be instrumental in achieving thorough admixture of the gas with the melt, to the greatest possible extent.

When manufacturing stainless steel in accordance with the AOD-process (Argon Oxygen Decarburization), the gas is introduced to the melt through a plurality of nozzles disposed in a converter. The nozzles are connected, via a vaporizer, to a storage container which contains gas in a liquid state. The storage container normally consists of a pressurized container having a working pressure of 16 or 25 bars. Because of pressure losses, the working pressure of 25 bars will give a maximum pressure of about 15 bars at the cold ends of the nozzles. In practice, this pressure is even lower, about 12 bars, because the process cannot be carried out with optimum values. The hydrostatic pressure in the converter in the locations of the nozzles can be about 4 bars, and hence the useful pressure-difference of the delivered gas flow is only about 8 bars A pressure in the order of 8 bars will cause the gas delivered to the melt to bubble up towards the surface of said melt in the form of relatively large gas bubbles. Because of the low pressure, these bubbles will rise relatively close to the wall where the nozzle concerned is situated. Thus, the system operates with a two-phase system, a gas-phase in the form of discrete bubbles and a liquid phase in the form of separate, homogenous lumps of melt, these two phases remaining separate from one another.

The present invention is based on the realization that gas could be better introduced into the melt and admixed therewith if it were possible to deliver the gas at a much higher pressure, therewith providing a greater impulse and improved conditions for achieving a more effective process and of eliminating certain problems associated with present-day techniques and render the process more positive.

When using a higher pressure than is typical at present, at least twice as high and preferably 10–20 times as high as typical pressures, there will be produced a gas jet which penetrates deeply into the melt and which is therewith atomized so as to obtain a jet zone which includes an emulsion-like finely divided mixture of gas and melt which is surrounded solely by melt. The specific surface contact area in the jet zone is very high and the molten material bordering on the jet zone will also be entrained by the jet and admixed therewith, which further enhances turbulence in the melt and the admixture of gas therewith. The result is a highly effective mixing process with effective contact between gas and melt.

The use of relatively low pressures in present-day techniques can also result in a hammering effect on the nozzle and subsequently result in mechanical fatigue in and wear on the refractory lining.

This hammering effect is eliminated when a high pressure is used. The high pressure will also enable the diameters of the nozzles to be considerably increased. In turn, this means that if a fault should occur as a result of fatigue, or for some other reason, and cause a nozzle to be forced from its fittings in the converter, the hole which results when using a high-pressure nozzle will be very small, therewith reducing the risk of injury.

A method of the kind mentioned in the introductory paragraph of the description is particularly characterized in that, in accordance with the invention, the gas is delivered to the melt in the form of at least one high-pressure jet; and in that the pressure of the jet is so great as to achieve a finely divided mixture of gas or melt in a jet zone in said melt.

The gas jet will preferably have a pressure within the range of 20–200 bars, preferably 70–130 bars.

For practical reasons, it is unsuitable to use a pressure container intended for this pressure as the working-gas storage container. An alternative is to store the gas in liquid form and to deliver the liquid gas to the nozzles via a vaporizer. However, it would require the provision of multi-stage compressors of impractical size in order to achieve the requisite pressure increase of the vaporized gas, and large quantities of energy would need to be cooled off.

These problems are solved in accordance with a further development of the inventive method, which is characterized by delivering the gas to the melt from a vaporizer connected to a storage container in which the gas is present in liquid form, and by increasing the vaporizer input pressure with the aid of a so-called cryopump connected in the conduit between the storage container and the vaporizer, such as to achieve the desired gas pressure in the gas jet.

The use of cry pumps for the purpose of elevating the pressure of gas in liquid state prior to vaporizing the liquid are known per se within other fields. However, the use of this technique within the metallurgical field for instance has not earlier been proposed and neither have the important advantages afforded by such an application been realized prior to the present invention. For instance, EP-A1-0 099 037 teaches a method of increasing the pressure upstream of a vaporizer with the aid of a pump, the pressure difference between the required consumer pressure and the pressure obtained downstream of the vaporizer being utilized in the operation of the cryopump. The consumer is intended to be driven with a relatively moderate pressure, in the order of 15 bars, also in the case of this Patent Specification, see for instance page 5, line 32.

The particular characteristic features of an arrangement for use when treating a melt with gas in accordance with the present invention are set forth in the following apparatus claims.

The invention will now be described in more detail with reference to the accompanying drawings.

Figure 1:
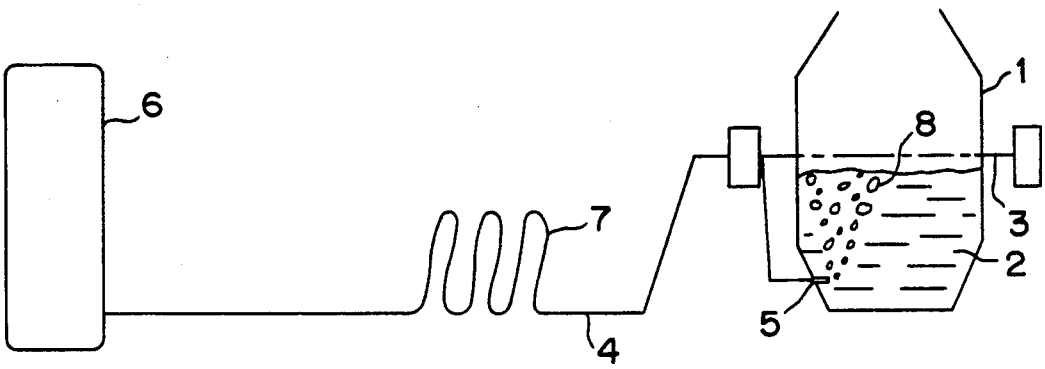
FIG. 1 illustrates schematically an arrangement constructed in accordance with known techniques.

FIG. 1 of the drawing illustrates schematically a converter 1 for manufacturing steel and containing a molten metal bath or melt 2. The converter can be tipped around an axis 3.

A gas pipe 4, for instance operative to deliver oxygen gas for the purpose of decarburizing the metal melt 2, is connected to a plurality of nozzles 5 mounted on one side of the converter, of which nozzles only one is shown. The gas source used is a storage container 6 which contains gas in liquid state, said liquid gas being vaporized in a vaporizer 7 prior to being delivered to the nozzles 5.

When the pressure in the storage container 6 is in the order of 25 bars, the pressure at the cold end of the nozzles 5 will be at most about 15 bars, and normally about 12 bars. Furthermore, if the hydrostatic pressure at the nozzle locations is about 4 bars, the useful working pressure will only be about 8 bars. This will cause the gas to rise towards the surface of the melt in the form of relatively large, discrete gas bubbles, without causing appreciable turbulence in the melt.

Figure 2:
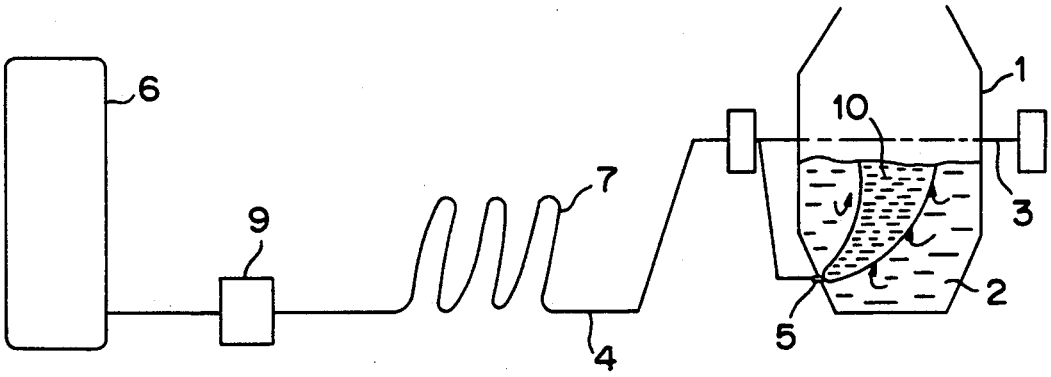
FIG. 2 is a corresponding arrangement which has been modified in accordance with the present invention.

FIG. 2 illustrates an arrangement which has been modified in accordance with the invention and in which a cryopump 9 is incorporated in the line between the storage container 6 and the vaporizer 7. This enables the gas pressure at the cold ends of the nozzles 5 to be considerably increased, at least doubled in relation to the pressure achieved with the FIG. 1 embodiment, in a simple and cost effective manner. The pressure should thus exceed 20 bars and may well lie in the vicinity of 200 bars. For practical reasons, it is preferred to select a pressure in the order of 70–130 bars.

A pressure of the aforesaid magnitude will result in the generation of a jet zone 10 in the melt 2, in which zone there is obtained an emulsion-like finely divided mixture of melt and gas, which provides a maximum contact surface area between said melt and gas, and also result in highly effective admixture of gas with melt as a result of the turbulence that ensues. This thorough admixture of gas with melt is achieved because the mixture, which moves forwards at high speed in the jet zone 10, will entrain surrounding melt 2 therewith. When using a plurality of such nozzles, for instance three nozzles, each nozzle will produce a mixing effect at a deeper depth into the melt than the nozzles of the FIG. 1 embodiment, and therewith, when seen in total, a much more effective mixture of the gas with the melt and more effective contact between said gas and said melt.

The use of a pressure-elevating cryopump in accordance with the invention also means that the arrangement between the pump and the converter need only include pipes and nozzles of small dimensions, which, among other things, renders the high-pressure system according to the invention more beneficial from the aspect of cost. Since the hammering effect on the nozzles which occurs at lower pressures, as explained in the aforegoing, is eliminated when practicing the invention, the mechanical stresses in the nozzle region are also reduced. Consequently, because of the small dimensions of the nozzle, any fault in the inventive nozzle or nozzle installation will carry a smaller injury risk than when using known nozzles of larger diameters. This is illustrated by the following example:

EXAMPLE

An AOD-converter for manufacturing stainless steel fitted with a cryopump between the liquid-gas storage container and the vaporizer, so that the high-pressure side was able to operate at a pressure of 120 bars. This enabled the diameter of the nozzles to be reduced from 12 mm to 1.75 mm. The decarburization rate was therewith increased by 13%. The formation of splashes was moderate and the consumption of enert gas was reduced by 8%.

Although the invention has been described in the aforegoing with particular reference to the decarburization of molten metal in the manufacture of steel, it will be understood by those skilled in this art that modifications can be made to enable the invention to be applied within other, similar fields without departing from the inventive concept.

I claim:

1. In the treatment of a metal melt with a gas in a converter according to the AOD-process, a method for intensifying and rendering more effective the contact between gas and melt so as to produce effective admixture of the gas with the melt which comprises by delivering the gas into the melt through at least one nozzle in the form of a high pressure jet directed essentially in the horizontal direction; by selecting a pressure which is so high as to achieve a finely-divided mixture of gas and melt in a jet zone in said melt; and by achieving the high pressure at the nozzle with the aid of a cryopump which is incorporated in a line extending between a storage container for gas present in a liquid state and a vaporizer connected to the nozzle, said cryopump increasing the inlet pressure to the vaporizer to such a value that the desired gas pressure at the nozzle is obtained.

2. A method according to claim 1 which comprises using a pressure within the range of 20–200 bars.

3. A method according to claim 1 which comprises using a pressure within the range of 70–130 bars.

4. An arrangement for use when applying the AOD-process for treating a metal melt (2) with gas in a converter (1) in order to intensify and render effective the contact between gas and melt and to produce effective admixture of gas with said melt, wherein said arrangement in a side wall includes at least one nozzle (5) which discharges into the melt (2) and which functions to deliver the gas in the form of at least one essentially horizontal high pressure jet; and wherein the arrangement further includes a cryopump (9) incorporated between a storage container (6) for gas present in a liquid state and a vaporizer (7) connected to the nozzle (5), said cryopump (9) increasing the inlet pressure to the vaporizer (7) to such a value that the desired gas pressure at the nozzle (5) is obtained.

* * * * *